United States Patent [19]

Frommherz

[11] Patent Number: 4,667,933

[45] Date of Patent: May 26, 1987

[54] GEAR TRANSMISSION FOR A WINCH

[75] Inventor: Egon Frommherz, Steinen, Fed. Rep. of Germany

[73] Assignee: Rotzler GmbH & Co. Spezialfabrik für Seilwinden und Hebezeuge, Steinen, Fed. Rep. of Germany

[21] Appl. No.: 762,105

[22] Filed: Aug. 2, 1985

[30] Foreign Application Priority Data

Aug. 4, 1984 [DE] Fed. Rep. of Germany ..... 3428874

[51] Int. Cl.[4] ..... B66D 1/22; B66D 1/26

[52] U.S. Cl. ..... 254/297; 242/155 BW; 254/303; 254/310

[58] Field of Search ..... 254/214, 219, 270, 271, 254/273, 278, 294, 295, 297, 298, 299, 300, 303, 317, 318, 344, 346, 347, 349; 242/47.09, 155 BW

[56] References Cited

U.S. PATENT DOCUMENTS

| | | | |
|---|---|---|---|
| 1,682,083 | 8/1928 | Johnston | 254/371 X |
| 2,663,386 | 12/1953 | Fenley | 254/272 X |
| 3,107,899 | 10/1963 | Henneman | 254/347 |
| 3,296,893 | 1/1967 | Shaffer et al. | 254/349 X |
| 3,460,807 | 8/1969 | Prikhodko et al. | 254/297 |
| 3,606,257 | 9/1971 | Wilson | 254/273 X |
| 4,226,405 | 10/1980 | Roodt | 254/272 X |
| 4,328,954 | 5/1982 | Logus | 254/344 |

FOREIGN PATENT DOCUMENTS

| | | | |
|---|---|---|---|
| 507793 | 11/1954 | Canada | 254/346 |
| 631849 | 6/1936 | Fed. Rep. of Germany | 254/346 |

*Primary Examiner*—Joseph J. Hail, III

*Attorney, Agent, or Firm*—Walter Ottesen

[57] ABSTRACT

A winch is disclosed which includes at least one rope drum about which a rope is slung as well as a transmission which is disposed between the rope drum and a drive motor. The transmission includes a drive shaft, an output shaft and a gear shifting device for different rope speeds. A stop brake is provided for the output shaft of the transmission. The gear shifting device is mounted between the drive shaft and the stop brake and is configured with respect to the output shaft so that it can be shifted from the second gear down to the first gear via a coupling disc which is actuated by a switching piston.

2 Claims, 6 Drawing Figures

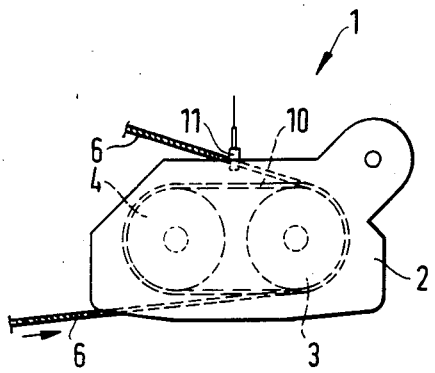
Fig. 2
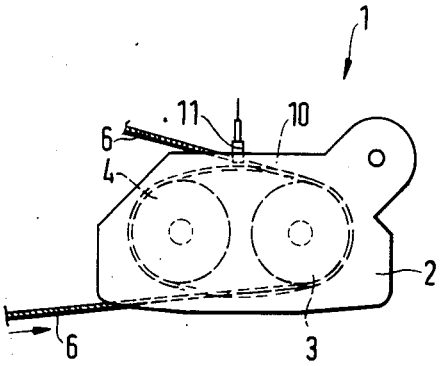
Fig. 3
Fig. 4
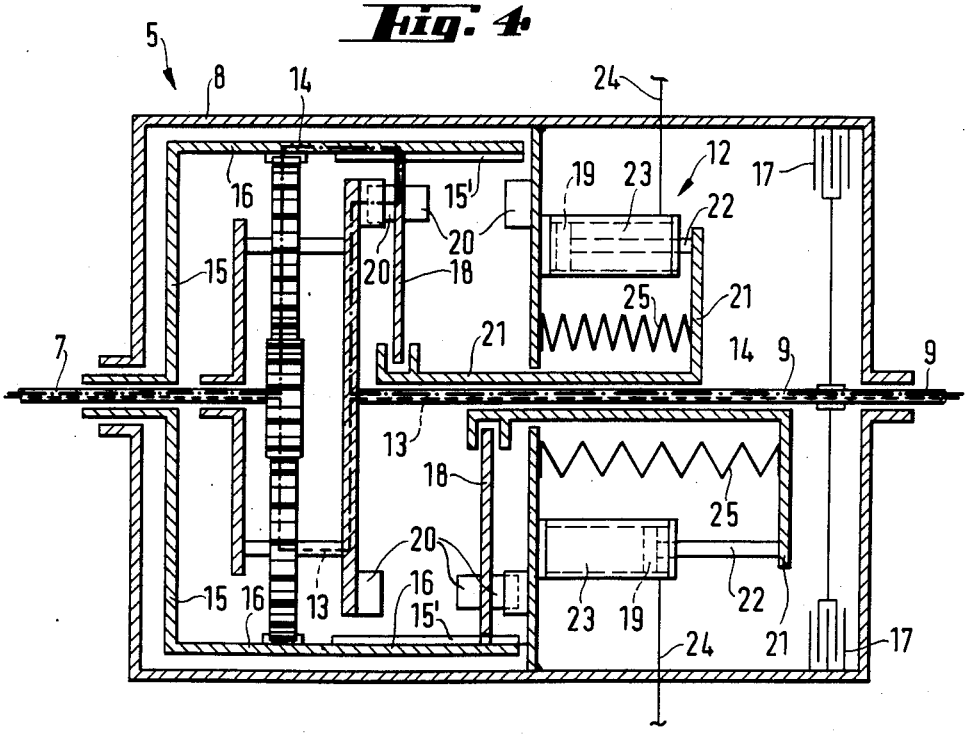

GEAR TRANSMISSION FOR A WINCH

FIELD OF THE INVENTION

The invention relates to a winch having at least one rope drum for accommodating a rope slung thereon. The winch includes a transmission located between a drive motor and the rope drum. The winch further includes a drive shaft, an output shaft and a gear switching device for obtaining different rope speeds.

BACKGROUND OF THE INVENTION

In a known winch, a spur gear assembly or a planetary gear assembly can be switched in and out via a mechanical two gear transmission in order to change the speed of the rope. An increase in rope speed causes a corresponding reduction in the pull load applied to the rope. Because of a change in the gear wheel engagement, a shift from the first gear to the second gear can only occur when no load is applied to the apparatus, that is, when the wire rope is unloaded. The switching occurs via a pneumatic drive which does not preclude the possibility that the switching operation can be performed even in the presence of a partial load when unfavorable conditions occur. In this connection, there is the danger that there can be suddenly no connection between the drive motor and the transmission so that the load suspended from the rope can return toward its starting position in an uncontrolled manner.

SUMMARY OF THE INVENTION

It is an object of the invention to provide a winch wherein gears can be shifted with greater ease also under load without interrupting the force flow. It is a further object of the invention to provide protection against an erroneous shifting under load.

The winch of the invention includes a frame housing; at least one rope drum rotatably mounted in the frame housing for accommodating a rope slung thereon to which a tension load can be applied; a drive motor mounted on the frame housing; a gear transmission disposed between the drive motor and the rope drum and having a drive shaft connected to the motor and an output shaft connected to the rope drum; gear switching means switchable between a first gear position of the transmission whereat the rope drum moves the rope at a first speed and a second gear position of the transmission whereat the rope drum moves the rope at a second speed; and, stop brake means for acting on the output shaft to hold the tension load while the gear switching means switches from the second gear position to the first gear position.

Preferred embodiments of the invention as well as the advantages and essential details thereof are disclosed in the drawing and in the description and claims which follow.

BRIEF DESCRIPTION OF THE DRAWING

The invention will now be described with reference to the drawing wherein:

FIG. 2 is a schematic representation of the winch for which the rope is under tension load;

FIG. 3 is a schematic representation of the winch wherein no load is applied to the rope;

FIG. 4 is a schematic representation of the switching transmission of the winch of FIGS. 1 to 3; and, FIG. 5 is a horizontal section taken through the winch of FIG. 1; and, FIG. 6 is an enlarged sectional view taken through the transmission identified by reference letter A in FIG. 5.

DESCRIPTION OF THE PREFERRED EMBODIMENTS OF THE INVENTION

Figure 1:
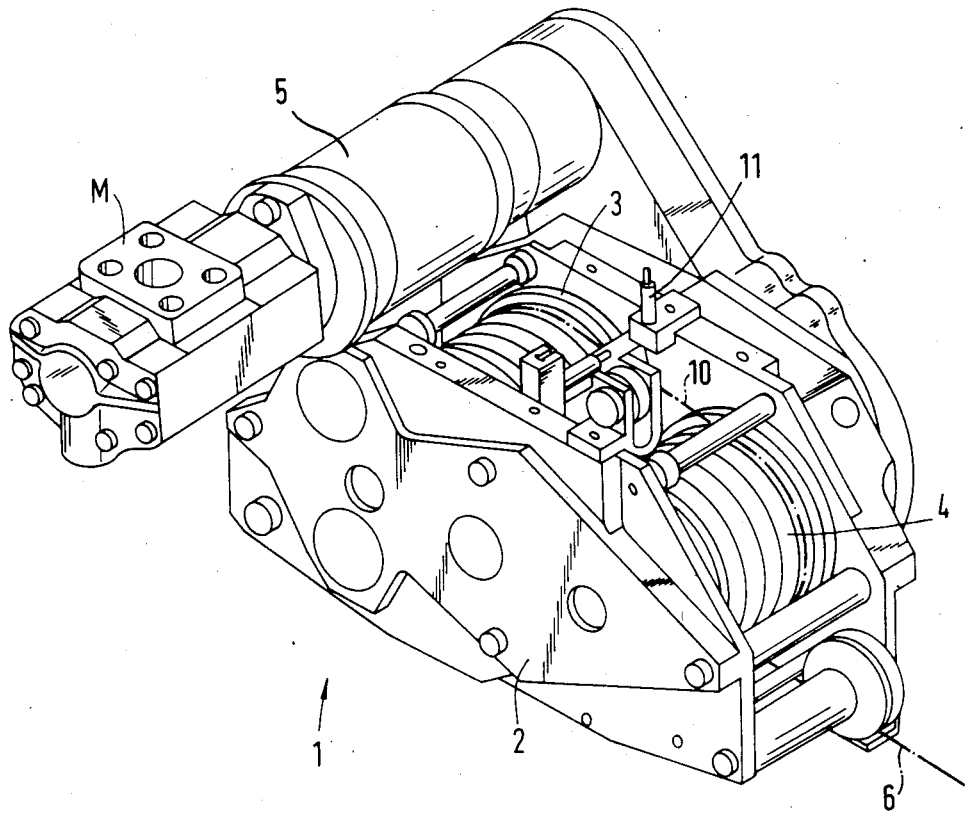
FIG. 1 is a perspective view of the winch according to the invention.

The winch 1 has a frame housing 2 with two rope drums 3, 4 and a transmission 5. A rope 6 is looped over the two rope drums. Rope 6 is guided in peripheral grooves of the rope drums 3, 4 and a load (not shown) is attachable to the rope.

Figure 5:
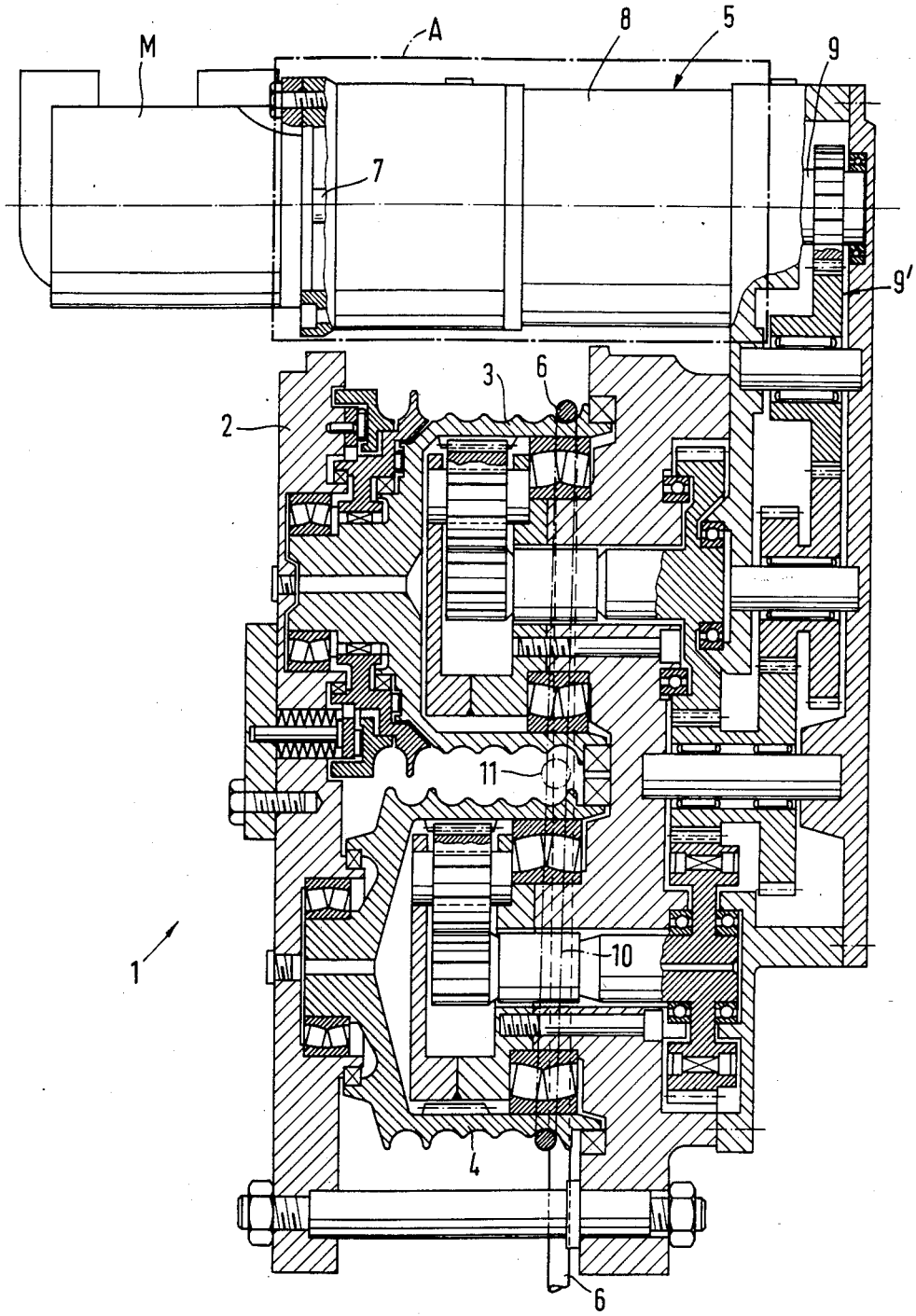

The two rope drums 3, 4 are driven by a motor M which is preferably configured as an oil engine. The drive shaft 7 (FIGS. 4, 5) is driven by the motor and is operatively connected to the transmission 5 disposed in housing 8. The transmission 5 is positioned ahead of the rope drums 3, 4 and has a take-off shaft 9 which drives the rope drums 3, 4 via an appropriate gear arrangement 9'.

In the embodiment shown, the rope 6 is placed in tension by means of an attached load so that the rope tightly surrounds both rope drums 3, 4. A proximity switch 11 is arranged in the space between the two rope drums 3, 4 and is mounted at a small spacing above the upper portion 10 of the rope 6. The spacing between the proximity switch 11 and the upper portion 10 is preferably approximately three to ten millimeters.

FIG. 3 shows that the rope 6 has no load applied thereto. The unloaded rope 6 is therefore relaxed so that it becomes curved in both the upward and downward directions in the space between rope drums 3, 4. The upper portion 10 of the rope 6 which is curved upwardly releases a pulse via the proximity switch 11 which acts on the gear shifting device 12 of the transmission 5 in such a manner that the gear shifting device 12 is unlatched for the step-up shift from the first gear 13 (shown in FIG. 4 by the dashed line) to the second gear 14 (shown in FIG. 4 by the dash-dotted line). If a load is applied to the rope 6 so that the rope is tightly tensioned and a larger spacing exists between the upper portion 10 and the proximity switch 11, then the gear shifting device 12 is latched so that a step-up shift from first gear 13 to the second gear 14 is not possible. In this way, an erroneous shift into the faster gear is prevented and it is assured that the loaded rope 6 will be driven at the slower speed for the full pulling force. The latching and/or unlatching of the gear shifting device 12 can be indicated to the person operating the winch in an advantageous manner via a light or acoustical signal so that the operator always receives the information without delay when the load-dependent safety latch has been released so that a rapid performance of the work task can be performed directly by switching up to the second gear 14.

Figure 6:
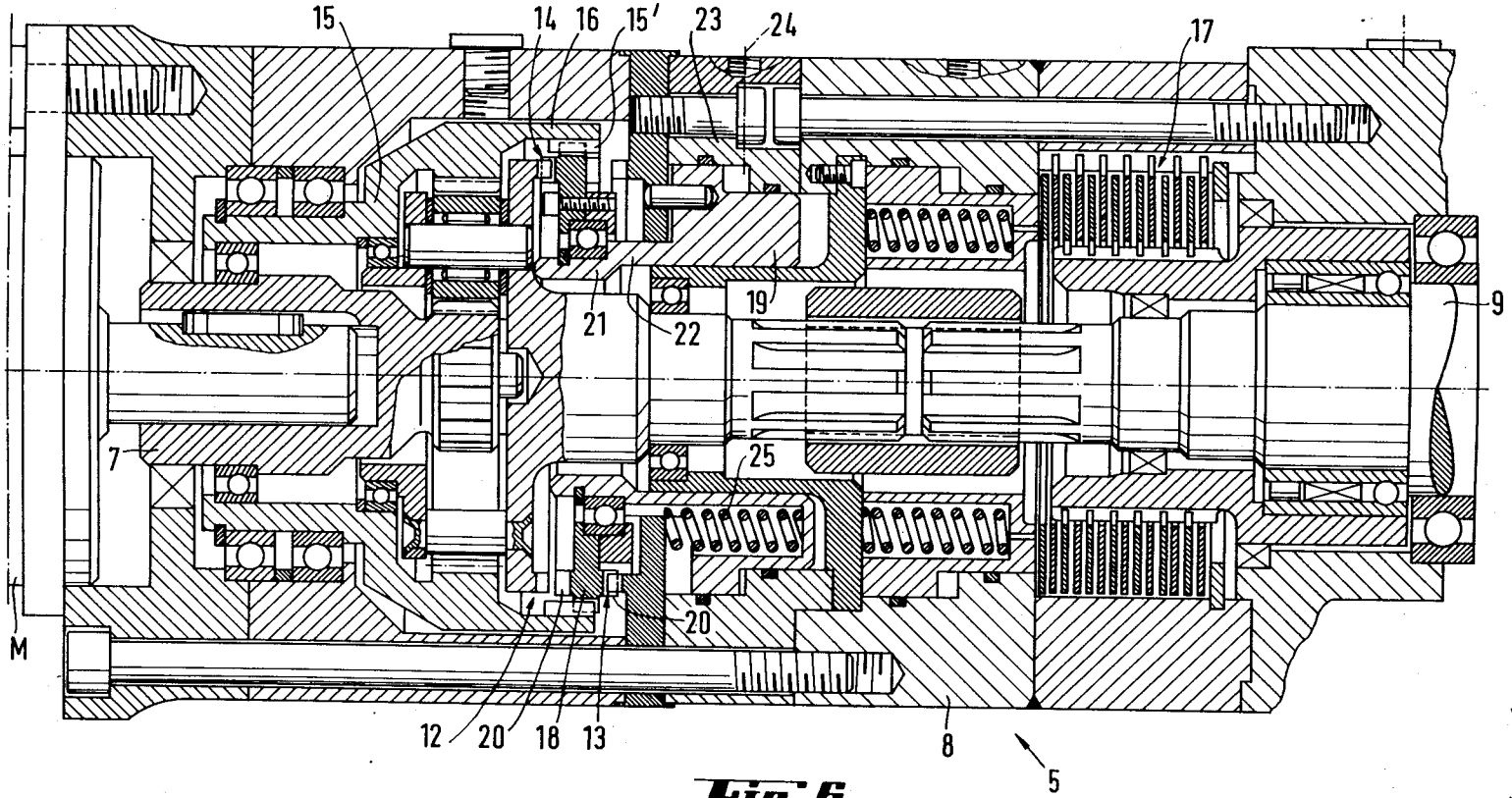

FIGS. 4 and 6 show that a drive gear 15 is provided in the housing 8 of transmission 5 on the end of the drive shaft 7. The drive gear 15 is preferably configured as a hollow wheel and has a tooth profile 15' (FIGS. 4 and 6) on its inner wall surface of peripheral wall 16. A hydraulic stop brake 17 is mounted at the opposite end of the transmission 5 in the housing 8. The stop brake 17 acts directly on the output shaft 9 and holds the load of rope 6 when the transmission 5 is switched.

The gear shifting device 12 is disposed in the region between the drive shaft 7 and the stop brake 17 and includes a coupling disc 18 as well as a switching piston 19. The switching piston 19 axially displaces the coupling disc 18 when switching from one gear to another gear. The clutch disc 18 includes coupling jaws 20. The coupling disc 18 is connected to the coupling hub 21 by a rod 22 of the switching piston 19. The switching piston 19 is axially displaceable in a cylinder 23 to which a line 24 is connected for hydraulically actuating the switching piston 19. A spring 25 is provided for the switching piston 19 and axially displaces the switching piston 19 and therefore also the coupling disc 18 in the direction opposite to the hydraulic force.

The lower half of FIG. 4 shows the force flow of the first gear 13 with the dashed line for which the rope 6 is driven at a lower speed but with full pulling force. For this condition, the coupling disc 18 and the switching piston 19 are displaced toward the right in the direction of stop brake 17 by means of the spring 25. The step-up switching from the first gear 13 to the second gear 14 is illustrated in the upper half of FIG. 4 by the dashed-dotted line representing the force flow. This step-up switching is only possible when the rope 6 is unloaded and the gear shifting device 12 is released via the proximity switch 11. For step-up switching, the switching piston 19 is pressed against the force of the spring 25 in the leftward direction by means of the hydraulic force introduced via line 24 into the cylinder 23 so that the coupling disc 18 is displaced to the left to the drive gear 15.

Step-down switching from second gear 14 to first gear 13 is achieved with the aid of the stop brake 17 so that this switching can be performed while rope 6 is under load. The load of rope 6 during these switching operations is fully taken up by means of the hydraulic stop brake 17 acting on the output shaft 9. In this way, a high level of safety is provided which makes it possible to switch back to first gear 13 at any time even when there is a sudden intense increasing tension load so that the full tension force for the increased load is available via the first gear 13.

It is understood that the foregoing description is that of the preferred embodiments of the invention and that various changes and modifications may be made thereto without departing from the spirit and scope of the invention as defined in the appended claims.

What is claimed is:

1. A winch comprising:

a frame housing;

at least one rope drum rotatably mounted in said frame housing for accommodating a rope slung thereon to which a tension load can be applied;

a drive motor mounted on said frame housing;

a gear transmission disposed between said drive motor and said rope drum and having a drive shaft connected to said motor and an output shaft connected to said rope drum;

gear switching means switchable between a first gear position of said transmission whereat said rope drum moves said rope at a first speed and a second gear position of said transmission whereat said rope drum moves said rope at a second speed greater than said first speed;

said gear transmission having a first gear power transmitting train corresponding to said first speed for connecting said drive shaft to said output shaft and a second gear power transmitting train corresponding to said second speed for connecting said drive shaft to said output shaft;

said gear switching means including: coupling disc means mounted in said transmission so as to be movable between said first position whereat said first gear transmission train drives said rope drum and said second position whereat said second gear transmission train drives said rope drum;

said gear transmission including a drive wheel mounted on said drive shaft, a spring for spring biasing said coupling disc means in a direction away from said drive wheel, said coupling disc means being movable along its axis against the force of said spring for coupling engagement with said drive wheel;

said switching piston means including: a cylinder and a piston movably mounted in said cylinder and connected to said coupling disc means; and, hydraulic means for actuating said piston for moving said coupling disc means against the force of said spring; and, stop brake means for acting on said output shaft to hold said tension load while said coupling disc means switches from said second position to said first position.

2. A winch comprising:

a frame housing;

at least one rope drum rotatably mounted in said frame housing for accommodating a rope slung thereon to which a tension load can be applied;

a drive motor mounted on said frame housing;

a gear transmission disposed between said drive motor and said rope drum and having a drive shaft connected to said motor and an output shaft connected to said rope drum;

gear switching means switchable between a first gear position of said transmission whereat said rope drum moves said rope at a first speed and a second gear position of said transmission whereat said rope drum moves said rope at a second speed greater than said first speed;

said gear transmission having a first gear power transmitting train corresponding to said first speed for connecting said drive shaft to said output shaft when said gear switching means is in said first position and a second gear power transmitting train corresponding to said second speed for connecting said drive shaft to said output shaft when said gear switching means is in said second position;

said gear switching means including: coupling disc means mounted in said transmission so as to be movable between said first position for defining said first gear transmission train drive and said second position for defining said second gear transmission train drive;

said gear switching means including a spring for resiliently biasing said clutch means into said first position, said coupling disc means being mounted so as to be movable against the force of said spring when moving from said first position to said second position;

said switching piston means including: a cylinder and a piston movably mounted in said cylinder and connected to said coupling disc means; and, hydraulic means for actuating said piston for moving said coupling disc means against the force of said spring and into said second position; and, stop brake means for acting on said output shaft to hold said tension load while said coupling disc means switches from said second positon to said first position.

* * * * *